US007484308B2

(12) United States Patent
Stravitz

(10) Patent No.: US 7,484,308 B2
(45) Date of Patent: Feb. 3, 2009

(54) CRAFTING AND GRAPHICS INSTRUMENTS

(76) Inventor: David M. Stravitz, 16 Park Ave., New York, NY (US) 10016

( * ) Notice: Subject to any disclaimer, the term of this patent is extended or adjusted under 35 U.S.C. 154(b) by 0 days.

(21) Appl. No.: 11/652,415

(22) Filed: Jan. 11, 2007

(65) Prior Publication Data

US 2007/0169363 A1 Jul. 26, 2007

Related U.S. Application Data

(60) Provisional application No. 60/760,746, filed on Jan. 20, 2006.

(51) Int. Cl.
*B43L 13/02* (2006.01)

(52) U.S. Cl. ..... 33/465; 33/41.1

(58) Field of Classification Search ..... 33/41.1, 33/41.2, 41.3, 41.4, 41.5, 41.6, 42, 43, 44, 33/45, 434, 435, 447, 454, 465, 565, 566
See application file for complete search history.

(56) References Cited

U.S. PATENT DOCUMENTS

| | | | | | |
|---|---|---|---|---|---|
| 139,507 | A | * | 6/1873 | Hitcock | 33/435 |
| 455,779 | A | | 7/1891 | Terry | |
| 496,825 | A | * | 5/1893 | Gillett | 33/447 |
| 527,134 | A | * | 10/1894 | Van Horn et al. | 33/435 |
| 598,875 | A | | 2/1898 | King | |
| 600,758 | A | | 3/1898 | Warren et al. | |
| 648,396 | A | | 5/1900 | Eaton | |
| 669,239 | A | | 3/1901 | Hill | |
| 795,065 | A | * | 7/1905 | Ring | 33/434 |
| 826,471 | A | | 7/1906 | Riedel | |
| 1,066,576 | A | | 7/1913 | Benton | |
| 1,092,107 | A | | 3/1914 | Jacobsen | |
| 1,117,092 | A | | 11/1914 | Riedel | |
| 1,349,550 | A | | 8/1920 | Magnuson | |
| 1,422,641 | A | | 7/1922 | Walters | |
| 1,464,973 | A | | 8/1923 | Dargue et al. | |
| 1,469,192 | A | | 9/1923 | Shepard | |
| 1,600,545 | A | | 9/1926 | Hooper | |
| 1,863,091 | A | * | 6/1932 | Allred | 33/41.5 |
| 2,089,757 | A | | 8/1937 | Nieuwkamp | |
| 2,239,323 | A | | 4/1941 | Hicks | |
| 2,420,090 | A | | 5/1947 | Nelson | |
| 2,879,597 | A | | 3/1959 | Burger | |
| 3,345,751 | A | * | 10/1967 | Barzee et al. | 33/435 |
| 4,048,725 | A | * | 9/1977 | Koenuma et al. | 33/447 |
| 4,246,702 | A | * | 1/1981 | Burt | 33/565 |
| 4,364,184 | A | | 12/1982 | Dowzall | |

(Continued)

*Primary Examiner*—G. Bradley Bennett
(74) *Attorney, Agent, or Firm*—Brian Roffe

(57) ABSTRACT

Crafting and graphics instrument including a base plate, a movable rod, a control mechanism for controlling movement of the rod relative to the base plate such that movement of the rod in only one direction is allowed while movement of the rod in an opposite direction is prevented, and an actuating arm assembly movable to different angular positions relative to the base plate. The actuating arm assembly includes at least one shaped surface enabling formation of a line or cut by drawing a writing implement or a cutting implement along it. As the rod moves, the actuating arm assembly also moves so that the shaped surface is laterally displaced across a substrate on which the instrument is placed. This enables the formation of a series of parallel lines or cuts in or on the substrate. A table-mounted version is also disclosed.

20 Claims, 3 Drawing Sheets

U.S. PATENT DOCUMENTS 4,539,759 A 9/1985 Dowzall et al.
4,790,077 A 12/1988 Tsujioka
6,305,090 B1 * 10/2001 Julien ..... 33/41.5

* cited by examiner

CRAFTING AND GRAPHICS INSTRUMENTS

CROSS REFERENCE TO RELATED APPLICATION

This application claims priority under 35 U.S.C. §119(e) of U.S. provisional patent application Ser. No. 60/760,746 filed Jan. 20, 2006, which is incorporated by reference herein.

FIELD OF THE INVENTION

The present invention relates generally to instruments for modifying planar substrates into particular shapes and/or forms and more particularly to a parallel liner type of device which is capable of making or enabling embossing or imprinting of one or a series of parallel lines or cuts on a planar substrate, and a support table integrated with such a device.

BACKGROUND OF THE INVENTION

The general concept of a parallel ruler, i.e., an instrument which is reliably adjustable to enable the formation of a series of parallel lines, is well-known in the art. Examples of U.S. patents which show parallel rulers, also referred to as parallel liners, section liners or section rulers, or related instruments include U.S. Pat. No. 455,779 (Terry), U.S. Pat. No. 598,875 (King), U.S. Pat. No. 600,758 (Warren et al.), U.S. Pat. No. 648,396 (Eaton), U.S. Pat. No. 669,239 (Hill), U.S. Pat. No. 826,471 (Riedel), U.S. Pat. No. 1,066,576 (Benton), U.S. Pat. No. 1,092,107 (Jacobsen), U.S. Pat. No. 1,117,092 (Riedel), U.S. Pat. No. 1,349,550 (Magnuson), U.S. Pat. No. 1,422,641 (Walters), U.S. Pat. No. 1,464,973 (Dargue et al.), U.S. Pat. No. 1,469,192 (Shepard), U.S. Pat. No. 1,600,545 (Hooper), U.S. Pat. No. 2,089,757 (Nieukamp), U.S. Pat. No. 2,239,323 (Hicks), U.S. Pat. No. 2,420,090 (Nelson), U.S. Pat. No. 2,879,597 (Burger), U.S. Pat. No. 4,364,184 (Dowzall), U.S. Pat. No. 4,539,759 (Dowzall et al.) and U.S. Pat. No. 4,790,077 (Tsujioka).

All of the references mentioned above are incorporated by reference herein.

OBJECTS AND SUMMARY OF THE INVENTION

It is an object of the present invention to provide a new and improved crafting and graphics instrument for modifying planar substrates.

It is another object of the present invention to provide a new and improved instrument which functions in a similar manner as a parallel ruler but enables not only the formation of a series of parallel, straight lines but also enables the formation of a series of parallel, curved lines and a series of parallel, irregular lines. Indeed, virtually any shape line can be created using instruments in accordance with the invention It is yet another object of the present invention to provide a new and improved instrument which can be used to modify planar substrates into particular shapes and/or forms, including making a series of parallel lines or cuts in or on paper and similar products, and embossing or otherwise imprinting a series of parallel lines or cuts on a planar substrate.

It is still another object of the present invention to provide a new support table integrated with a crafting and graphics instrument.

In order to achieve at least one of these objects and others, a crafting and graphics instrument in accordance with the invention includes a base plate, a movable rod, a control mechanism for controlling movement of the rod relative to the base plate such that movement of the rod in only one direction is allowed while movement of the rod in an opposite direction is prevented, and an actuating arm assembly movable to different angular positions relative to the base plate. The actuating arm assembly includes at least one shaped surface enabling formation of a line or cut by drawing a writing implement or a cutting implement along it. As the rod moves, the actuating arm assembly also moves so that the shaped surface is laterally displaced across a substrate on which the instrument is placed. This enables the formation of a series of parallel lines or cuts in or on the substrate.

One embodiment of an actuating arm assembly includes an actuating arm connected to the rod, a template including or defining the shaped surface(s) and an attachment mechanism for removably attaching the template to the actuating arm. The attachment mechanism may entail a plurality of projections formed on an upper surface of the actuating arm, e.g., a pair of projections spaced apart a distance substantially equal to a distance between a pair of apertures formed on the template.

The actuating arm can also include a base attached to the rod at an intermediate position between ends of the rod and a ruler pivotally connected at one end region to the base such that the ruler is movable to a plurality of angular positions relative to the base and thus the rod. The projections are formed on an upper surface of the ruler. The base includes a coupling portion attached to the rod and a substantially circular portion alongside the coupling portion and having an arcuate slot. The ruler may be pivotally connected to a centerpoint of the circular portion. A locking member passes through the slot on the circular portion to lock the ruler in an angular position relative to the circular portion. Thus, the same angular orientation of the ruler, and template attached thereto, is maintained during lateral movement of the rod along the base plate.

Another embodiment of an actuating arm assembly includes a base attached to the rod at an intermediate position between ends of the rod, and a template including or defining the shaped surface(s). The template is pivotally connected at one end region to the base such that the template is movable to a plurality of angular positions relative to the base and thus the rod. The base can include a coupling portion attached to the rod and a substantially circular portion alongside the coupling portion. The template is pivotally connected to a centerpoint of the circular portion. A locking member passes through an arcuate slot in the circular portion to lock the template in an angular position relative to the circular portion.

Another embodiment of a crafting and graphics instrument in accordance with the invention includes a table, a rod mounted in connection with and movable relative to the table, a control mechanism for controlling movement of the rod relative to the table such that movement of the rod in only one direction is allowed while movement of the rod in an opposite direction is prevented, a platen movable relative to and in a channel formed by the table upon movement of the rod and arranged to support a substrate thereon, and an implement connected to the table and including an operative tool positionable in engagement with the substrate supported on the platen. In this embodiment, the substrate secured to the platen can be moved at predetermined and constant increments relative to the tool on the implement to enable the formation of a plurality of parallel lines or cuts on the substrate.

To cause movement of the platen upon movement of the rod, a plate is connected to the rod and has a projection which is accommodated in an aperture formed in the platen and dimensioned to accommodate it. Thus, when the rod moves, the plate moves causing the platen to move.

An added feature of this embodiment is that the increment in which the rod moves is adjustable. To this end, a mechanism for limiting movement of the rod is provided, i.e., it limits it to a predetermined and adjustable amount of movement upon each manually-derived indexing of the rod. The mechanism includes an elongate plate arranged on the table which is movable to vary the dimension of a slot in which a lever coupled to the rod is movable. The lever, when manually moved in the slot, causes indexing of the rod. As such, by adjusting the size of the slot, the maximum allowed movement of the lever is set resulting in a uniform, incremental indexing of the rod.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
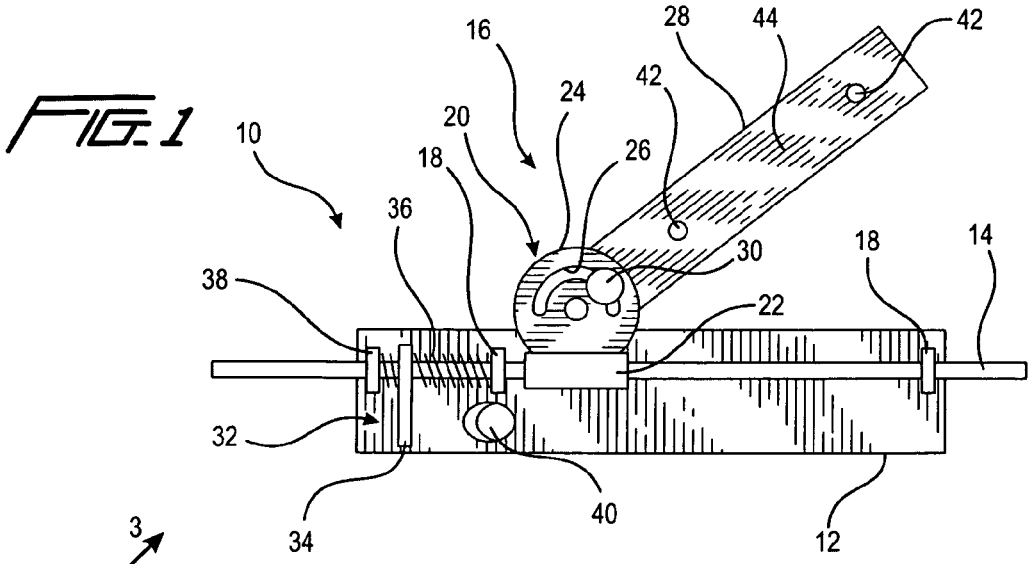
FIG. 1 is a top plan view of a crafting and graphics instrument in accordance with the invention, shown without a template thereon.

Referring to the accompanying drawings wherein like reference numbers refer to the same or similar elements, a first embodiment of a crafting and graphics instrument in accordance with the invention is shown in FIG. 1 and designated 10. Instrument 10 includes a base plate or bed 12, an elongate rod 14 movable relative to the base plate 12 and an actuating arm 16 angularly movable relative to the base plate 12. Guide projections 18 are attached to or formed integral with the base plate 12 and by virtue of the rod 14 passing through channels in the guide projections 18, the guide projections 18 guide movement of the rod 14 relative to the base plate 12. Other mechanisms for guiding movement of the rod 14 along and/or relative to the base plate 12 are also contemplated, including those disclosed in the prior art mentioned above.

In this embodiment, actuating arm 16 is an assembly of components including a base 20 having a coupling portion 22 which attaches the actuating arm 16 to the rod 14 at an intermediate position between the ends of the rod 14, for example, close to or at a mid-point of the rod 14, and a substantially circular portion 24 having an arcuate slot 26 and which is connected to the coupling portion 22. Actuating arm 16 also includes a ruler 28 pivotally connected at one end region to the base 20 and preferably to an approximate centerpoint of the circular portion 24 to enable the ruler 28 to be moved to a plurality of different angular positions relative to the base 20 and circular portion 24 thereof, and thus the rod 14.

Actuating arm 16 also includes a tightening or locking screw 30 threaded through the slot 26 to engage with the ruler 28 and when tightened against the ruler 28, it fixes the ruler 28 in one angular position relative to the circular portion 24 and thus relative to the rod 14 since the circular portion 22 is fixed relative to the rod 14. Alternatively, other mechanisms for fixing the angular position of the ruler 28 relative to the rod 14 can also be used in the invention, including those described in the prior art mentioned above.

Instrument 10 also preferably includes a mechanism 32 to control the movement of the rod 14 along the base plate 12. One such mechanism is shown in FIG. 1 and includes a lever 34 for enabling movement of the rod 14 from an initial position in one direction along the base plate 12, a spring 36 biased to return the lever 34 to the initial position and a locking clamp 38 for preventing backward movement of the rod 14. Optionally, an eccentric gage 40 is provided to regulate the length of movement of the rod 14 along the base plate 12. This type of mechanism has been implemented in the section liner described in U.S. Pat. No. 669,239 (Hill) and additional details can be found therein. Alternative mechanisms to control the movement of the rod 14 along the base plate 12 have been developed and these alternative mechanisms can be used in the invention along with any and all other mechanisms which control movement of the rod 14 along the base plate 12. One reason for this is because the invention, in one aspect described immediately below, relates primarily to a modification of the actuating arm 16 and thus the structure of the rod 12, base plate 14 and other components which enable movement of the rod 14 along the base plate 12 are freely selectable from those in the prior art or improvements to be developed in the future.

In accordance with the invention, instrument 10 includes structure for removably attaching a template to enable the creation of a plurality of different shapes of lines via the template, in particular lines which are not straight, such as curved lines and irregular lines which may have straight and curved portions. In prior art parallel liners such as those described in U.S. Pat. No. 455,779 (Terry) and U.S. Pat. No. 669,239 (Hill), the only possible lines that could be formed are straight lines by drawing a writing instrument along the straight edges of the ruler portion of the actuating arm. However, in addition to enabling the formation of straight lines in the same manner, the ruler 26 of actuating arm 16 includes a pair of projections 42 formed on and extending upward from the upper surface 44. Projections 42 enable the placement of templates 46A, 46B which have corresponding pairs of apertures 48A, 48B with the same spacing as that between projections 42. Instead of corresponding pairs of projections and apertures, other structure for enabling a secure yet removable placement of the templates 46A, 46B on the actuating arm 16 in general or on the ruler 28 of the actuating arm 16 in particular, can be used in the invention, e.g., three projections and apertures, an irregular projection and corresponding aperture.

Figure 2:
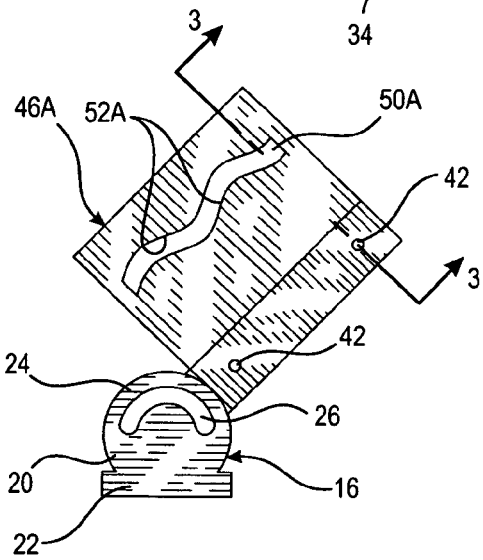
FIG. 2 is a top plan view of a first embodiment of an actuating arm unit of the instrument shown in FIG. 1.

Each template 46A, 46B includes or defines one or more particular shapes of lines to be formed using it. As shown in FIG. 2, one template 46A has a slot 50A defined primarily by a pair of opposed undulating surfaces 52A. Using template 46A, it is therefore possible to form a pair of parallel, undulating lines by drawing a writing instrument along undulating surfaces 52A or a pair of parallel, undulating cuts by drawing a cutting instrument such as a blade along the undulating surfaces 52A. Although template 46A shows a pair of opposed, substantially parallel undulating surfaces 52A, it could alternatively include only a single undulating surface or opposed, non-parallel surfaces.

Figure 4:
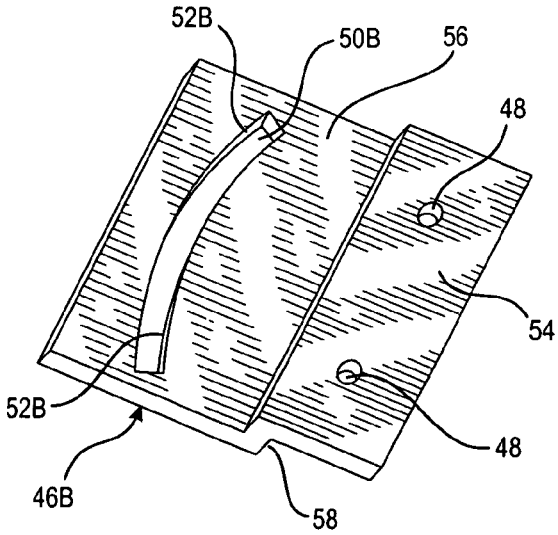
FIG. 4 is a perspective view of another template for use in the invention.

As shown in FIG. 4, template 46B has a slot 50B defined primarily by a pair of opposed arcuate surfaces 52B. Using template 46B, it is therefore possible to form a pair of parallel, arcuate lines (lines having the same radius of curvature) by drawing a writing instrument along arcuate surfaces 52B or a pair of parallel, arcuate cuts by drawing a cutting instrument such as a blade along the arcuate surfaces 52B. Although template 46B shows a pair of opposed, substantially parallel arcuate surfaces 52B, it could alternatively include only a single arcuate surface or opposed, non-parallel surfaces.

Figure 3:
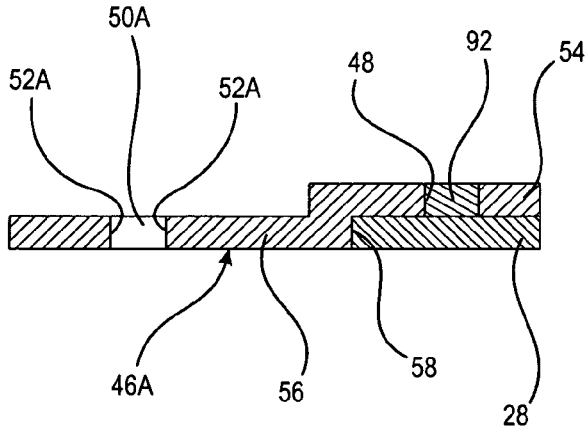
FIG. 3 is a cross-sectional view taken along the line 3-3 in FIG. 2.

Templates 46A, 46B are preferably constructed to rest against the substrate on which a line will be formed by drawing a writing implement along the shaped surface(s) 52A, 52B or in which a cut will be formed by drawing a cutting implement along the surface(s) 52A, 52B. To this end, templates 46A, 46B can be constructed as shown in FIG. 4 including a first planar portion 54 in which the apertures 48A, 48B are formed and which has a lower surface which will rest on the ruler 28 of the actuating arm 16, and a second planar portion 56 which has a lower surface which will rest on the substrate. Since the ruler 28 will also rest on the substrate, a step 58 is present between the planar portions 54, 56 (see FIGS. 3 and 4). The step 58 may be positioned so that it is close to or possibly in contact with the edge of the ruler 28. The shaped surface(s) which enable the formation of a line or cut, depending on whether a writing implement or cutting implement is used, is/are formed in the second planar portion 56.

Ideally, it is envisioned that a multitude of templates will be designed for use with instrument 10. These templates could include a step 58 and the proper spacing between the projections 42, or simply only the proper spacing between the projections 42.

However, it is conceivable that templates currently made by craft apparatus manufacturers can be used with the instrument 10. Thus, in one embodiment of the invention, the projections 42 are spaced apart a distance which is equal to the spacing between a pair of apertures formed in existing shape and line-forming templates, e.g., templates sold by Fiskars and under the tradename SHAPECutter. Some of these templates are formed in various shapes, e.g., heart-shaped, circular, rectangular, square, oval, etc. with an open interior, while others are generally rectangular and define a plurality of apertures therein having particular shapes, e.g., one template has apertures shaped like animals, another has different sizes of rectangular apertures, another has letters and numbers, etc. Importantly, these templates usually have circular apertures along one side to enable them to be inserted into looseleaf notebooks, i.e., three or five-ring notebooks. By providing the same spacing between projections 42 as the spacing between any pair of apertures on existing templates, the existing templates can be used with the instrument 10 in accordance with the invention. This greatly expands the possible uses of the instrument 10 to encompass the formation of lines and cuts having all shapes and sizes as found on existing templates.

To use instrument 10 to make a series of parallel lines or cuts, the instrument 10 is placed at an initial position on a planar substrate lying on a flat surface defined by a board or mat and which can be cut or on which a line is to be drawn, embossed or otherwise imprinted. The board or mat which the instrument 10 is placed is preferably a self-healing craft mat such as those manufactured by Fiskars, which is user-friendly to maintain the service life of the blade. To secure the instrument 10 to the board or mat, the instrument 10 can include one or more projections, preferably at least two, protruding from the lower surface of the instrument 10, i.e., from the base plate 12 thereof, and are stable enough to maintain the instrument 10 in a fixed position relative to the board or mat. The projections may be nails.

One of the templates 46A, 46B is engaged with the actuating arm 16 by aligning the apertures 48A, 48B on the template 46A, 46B with the projections 42 on the actuating arm 16. The actuating arm 16 is pivoted to an angular position in which the shaped surface(s) of the template 46A, 46B engaged therewith is in a desired position and locked in place by tightening locking screw 30. A writing or cutting instrument is then guided along the shaped surface or surfaces of the template 46A, 46B to form one or more lines or cuts in the planar substrate (the line or cut having the same shape as the surface, e.g., arcuate, undulating or another non-straight line). Note that a single cutting implement can be used to make a cut along each of a pair of opposed shaped surfaces, i.e., along both surfaces 52A, 52B in the templates 46A, 46B.

The rod 14 is then moved along the base plate 12 to a new position such that the actuating arm 16 is also moved to a new position. This is achieved by sliding lever 34 in one direction (toward the right in FIG. 1). Once the sliding lever 32 is moved by the preset increment, it is released and returns to its original position while the rod 14 remains in its displaced position. The writing or cutting instrument is then again guided along the shaped surface or surfaces of the template 46A, 46B to form additional lines or cuts in the planar substrate. These lines or cuts will be substantially parallel to the initial set of lines or cuts formed in the substrate. By continuing to move the rod 14 along the base plate 12 in substantially equal advancements or increments, additional parallel lines or cuts can be formed in the substrate. This procedure of sequentially indexing the rod 14 continues until the desired number of lines or cuts is formed in the substrate. Instrument 10 is then lifted off of the substrate.

In the embodiments described above, a separate template is attached to the actuating arm 16 of the instrument 10, with the template defining one or more surfaces (shaped surfaces) enabling the formation of a line or cut by drawing a writing implement or a cutting implement along the surface(s), the surface capable of having various forms other than entirely straight. Instead of providing a separate template for attachment to an actuating arm, it is possible to construct the actuating arm itself to have one or more surfaces enabling the formation of a non-straight line or cut by guiding or drawing a writing implement or a cutting implement along the surface (s).

Figure 5:
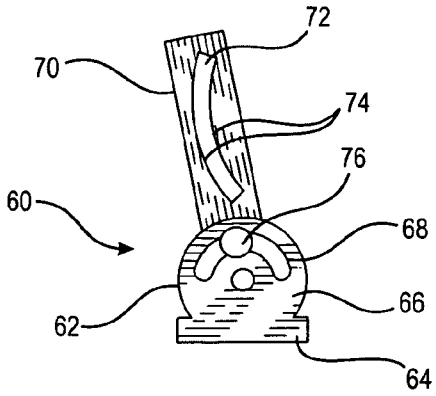
FIG. 5 is a top plan view of a second embodiment of an actuating arm unit in accordance with the invention.

In this regard, referring to FIG. 5, actuating arm 60 is formed from a different assembly of components and includes a base 62 having a coupling portion 64 which attaches it to a rod (not shown) at an intermediate position between the ends of the rod (in a similar manner as coupling portion 22 attaches actuating arm 16 to rod 14 as described above), and a substantially circular portion 66 having an arcuate slot 68 and which is connected to the coupling portion 64. Actuating arm 60 also includes a template 70 pivotally connected at one end region to a centerpoint of the circular portion 66 to enable the template 70 to be moved to a plurality of different angular positions relative to the circular portion 66, and thus the rod.

Template 70 includes or defines one or more particular shaped surfaces enabling lines or cuts to be formed using it, e.g., by guiding a writing, embossing or cutting implement along each shaped surface. As shown in FIG. 5, template 70 has a slot 72 defined by a pair of opposed arcuate surfaces 74. Using template 70, it is therefore possible to form a pair of parallel, arcuate lines (lines having substantially the same radius of curvature) by drawing a writing instrument along arcuate surfaces 74 or a pair of parallel, arcuate cuts by drawing a cutting instrument such as a blade along the arcuate surfaces 74. Although template 70 shows a pair of opposed parallel or non-parallel arcuate surfaces 74, it could alternatively include only a single arcuate surface, a single undulating surface, a pair of opposed undulating surfaces (see the template 46A in FIG. 2) or any other form of surfaces, especially non-straight surfaces.

A tightening or locking screw 76 is threaded through the slot 72 to engage with the template 70 and when tightened against the template 70, it fixes the template 70 in one angular position relative to the circular portion 66 and thus relative to the rod since the circular portion 66 is fixed relative to the rod. Alternatively, other mechanisms for fixing the angular position of the template 70 relative to the rod can also be used in the invention, including those described in the prior art mentioned above.

Use of actuating arm 60 on an instrument in accordance with the invention is similar to use of instrument 10 with a template 46A, 46B, but does not require attachment of a template 46A, 46B to the ruler 28 since the ruler and template combination of the embodiment described above has been effectively substituted for by integrated template 70. When a different shaped surface is desired, the template 70 is detached from the base 62 and a new template 70 is installed in connection with base 62.

It is pointed out that the above-described uses of instrument 10 with either actuating arm 16 or actuating arm 60 are not limiting and other uses are possible.

Figure 6:
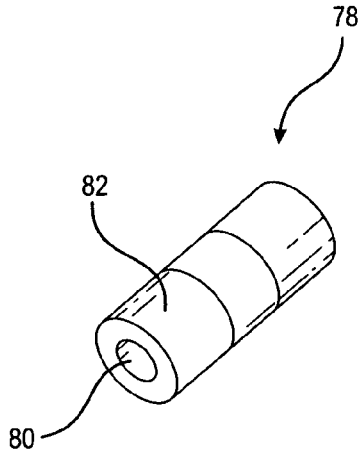
FIG. 6 is a perspective view of a cutting blade assembly for use with the crafting and graphics instruments in any of the embodiments shown in FIGS. 1-5.
Figure 7:
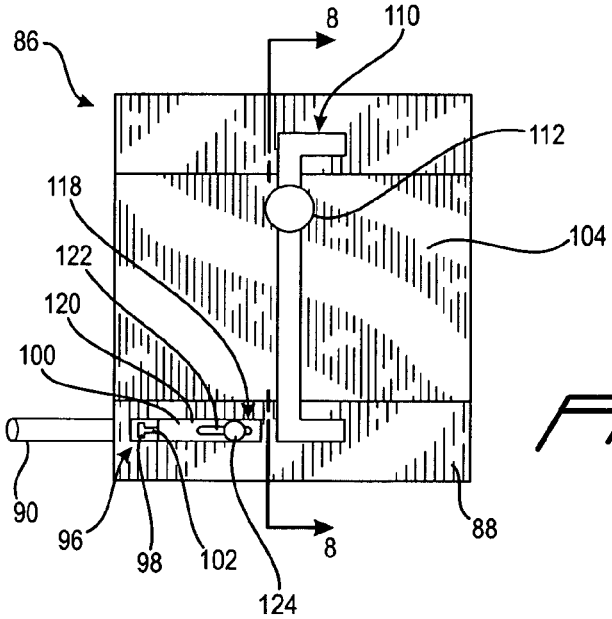
FIG. 7 is a top plan view of another embodiment of a crafting and graphics instrument in accordance with the invention.
Figure 8:
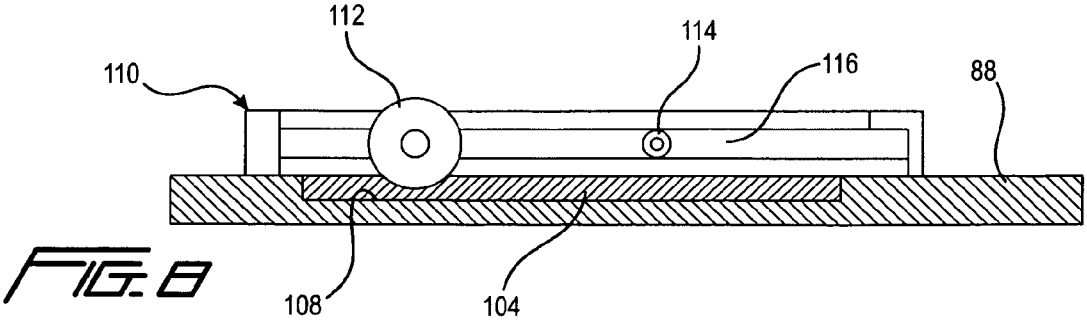
FIG. 8 is a cross-sectional view taken along the line 8-8 in FIG. 7.

FIG. 6 shows a cutting blade assembly 78 for use with templates 46A, 46B, 70. Cutting blade assembly 78 includes a swivel blade 80, of a type known in the art, and a substantially cylindrical housing 82 which secures the swivel blade 80 such that it can "float" during movement of the cutting blade assembly 78. The diameter of the housing 82 is selected to enable the cutting blade assembly 78 to be positioned in the slots 50A, 50B, 72 so that as the cutting blade assembly 78 is guided through the slot 50A, 50B, 72 with its lower edges moving along the surfaces 52A, 52B, 74, the swivel blade 80 forms a curve having substantially the same shape as the surfaces defining the slot.

One drawback of the instruments described above is that they all require the base plate to be maintained in substantially the same position during movement of the actuating arm. Any movement of the base plate will adversely affect the spacing and orientation of the cuts or lines formed using the actuating arm.

An instrument in accordance with the invention which overcomes this drawback is shown in FIGS. 7-10 and designated 86. Instrument 86 includes a table 88 and a rod 90 mounted in connection with and movable relative to the table 88. Rod 90 is connected to a plate 92 having a raised boss, pin or projection 94 so that the projection 94 moves whenever the rod 90 moves. Structure is provided to guide movement of the rod 90 relative to the table 88 (similar to the structure described above with respect to the manner in which rod 14 is guided relative to base plate 12 or any structure described in the prior art mentioned above).

Instrument 86 further includes a mechanism 96 which controls the movement of the rod 90 relative to the table 88. Control mechanism 96 includes a lever 98 for enabling movement of the rod 90 relative to the table 88 from an initial position in a slot 100 formed in the table 88 in one direction toward an opposite end of the slot 100 (toward the right in FIGS. 7 and 10), and a spring 102 biased to return the lever 98 to the initial position. A locking clamp or other locking mechanism (not shown) prevents backward movement of the rod 90 in a similar manner as locking clamp 38 in the embodiment described above.

Rod 90 is controllably and incrementally moved by sliding the lever 98 from one end of the slot 100 toward the opposite end, then releasing the lever 98 causing it to return to its initial position (while the rod 90 remains in the displaced position), and thus the lever 98 is ready to be slid once more toward an opposite end of the slot 100.

Alternative mechanisms to control the incremental movement of the rod 90 relative to the table 88, while preventing its backward movement, can be used in the invention such as those which control movement of a rod along a base plate as described above and in the prior art mentioned above. One reason for this is because for this embodiment of the invention, the novelty does not primarily lie in the manner in which the rod is indexed and thus any indexing mechanism or rod movement control mechanism can be utilized in the invention.

Instrument 86 also includes a movable platen 104 which is moved upon movement of the rod 90. Platen 104 can be fixed or removably coupled to the rod 90. In the illustrated embodiment, the platen 104 is removably coupled to the rod 90 by forming an aperture 106 in the platen 104 adapted to accommodate the projection 94 and placing the platen 104 in a channel 108 formed on the table 88 such that the projection 94 is received in the aperture 106. Platen 104 is therefore moved incrementally through the channel 108 in conjunction with the incremental movement of the rod 90. However, since the rod 90 remains in the displaced positions after movement thereof, the platen 104 also remains in the displaced positions so that any substrate on the platen 104 is incrementally moved relative to the table 88.

Instrument 86 also includes a fabricating implement, represented in the illustrated embodiment by a cutting implement or armature 110, mounted at its ends to upper surfaces of the table 88 on opposite sides of the channel 108. Cutting implement 110 may be any conventional cutting implement or assembly which is capable of movement between a first position pivoted away from the table 88 and platen 104 in the channel 108 on the table 88 and a second position in which a cutting tool 112 of the cutting implement 110 is capable of engaging with a substrate on the upper surface of the platen 104 and therefore capable of cutting the substrate. Cutting implement 110 is moved to the first position to enable access to the platen 104, i.e., to place and secure a substrate thereon, and then to the second position to cut the substrate.

An adjustable locking mechanism, such as a locking knob 114, is optionally arranged on the cutting implement 110 to limit the travel of the cutting tool 112. Locking knob 114 is movable in a slot 116 which is typically formed on the cutting implement 110 and may be the same slot along which the cutting tool 112 slides.

Instead of cutting implement 110 and cutting tool 112, it is possible to mount any type of writing, scribing, embossing or engraving implement to the table 88 or any type of writing, scribing, engraving or embossing tool to the cutting implement 110. Such an implement would have an operative position fixed relative to the table 88 with the substrate being modified by the implement being moved relative to the implement upon movement of the platen 104. Thus, this arrangement differs from the embodiments described above with respect to FIGS. 1-5 wherein the instrument 10 is moved relative to the substrate being modified or worked on.

Table 88 also includes a mechanism 118 which limits movement of the rod 90 to thereby enable variable displacement of the platen 94. Mechanism 118 comprises an elongate plate 120 movable in the slot 100 and including a slot 122 and a locking mechanism 124 passing through slot 122 for locking the plate 120 in a fixed position relative to the table 88. Locking mechanism 124 is rotated in one direction to press the plate 120 against the table 88 to lock it in one of a plurality of different positions depending on the position of the plate 120 relative to the locking mechanism 124 and in the opposite direction to enable the plate 120 be slid to different positions.

Mechanism 118 limits movement of the rod 90 by varying the size of slot 100. When slot 100 is relatively large, a large increment in the movement of the rod 90 and thus the platen 104 is obtained while when slot 100 is relatively small, a small increment in the movement of the rod 90 and platen 104 is obtained. The size of the slot 100 can be visually determined by providing measurement markings along the slot 100 and/or on the plate 120.

Figure 9:
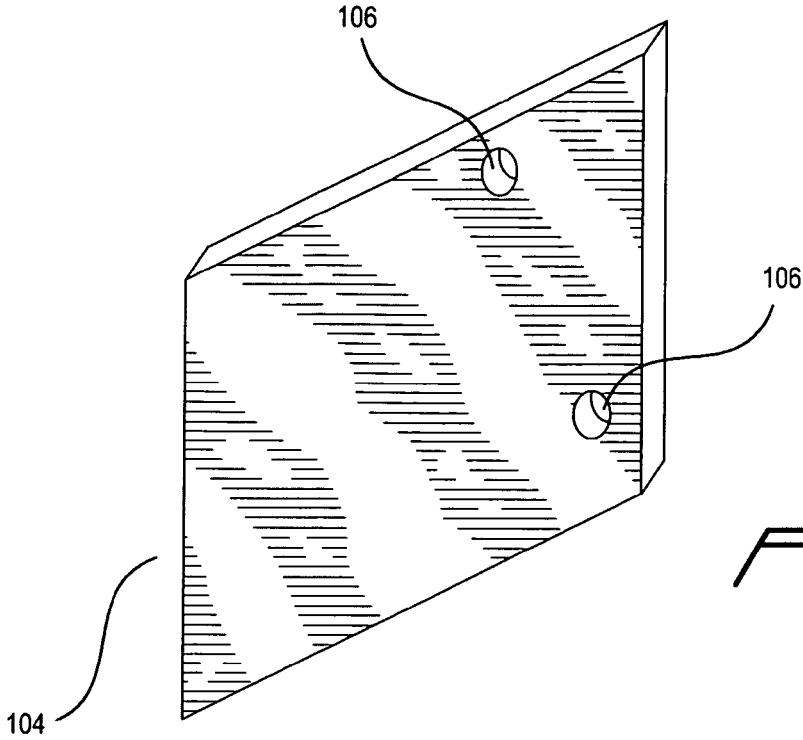
FIG. 9 is a perspective view of platen of the instrument shown in FIG. 7.
Figure 10:
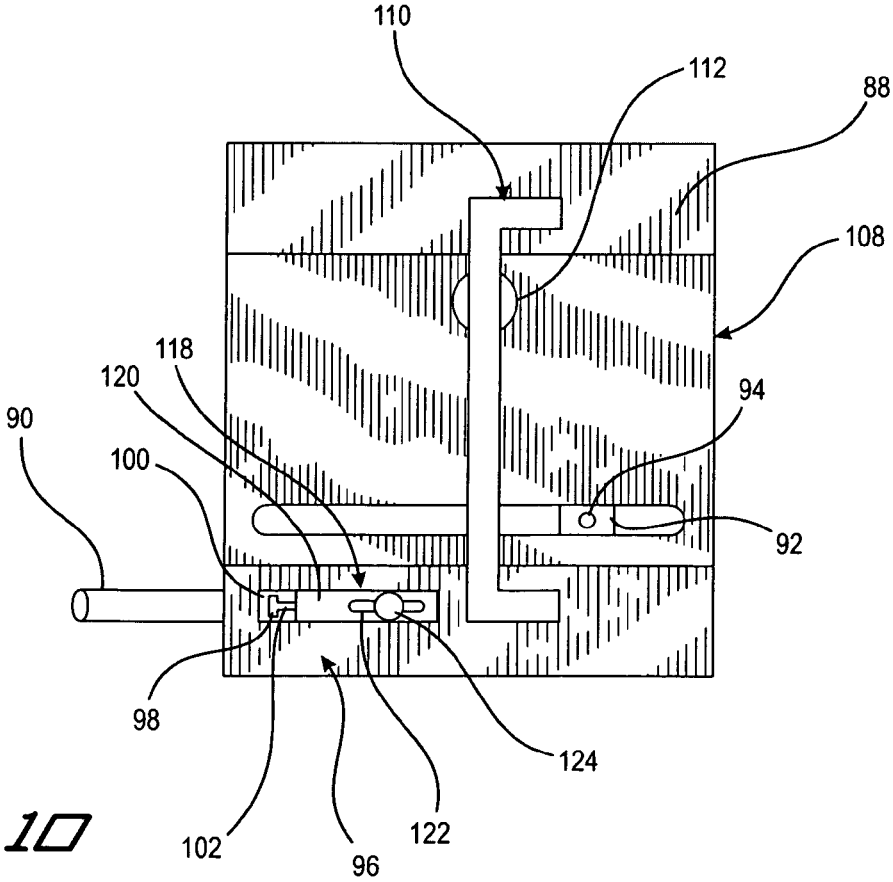
FIG. 10 is a top plan view of the instrument shown in FIG. 7 without the platen.

A particular advantage of instrument 86 is that the platen 104 can be positioned in different orientations relative to the table 88 by forming a plurality of apertures 106 in the platen 104, e.g., along a pair of perpendicular edges as shown in FIG. 9, with each aperture 106 being dimensioned to accommodate the projection 94 connected to rod 90. In this manner, it is possible to form cuts or lines in a substrate fixed to the platen 104 with the platen 104 mounted in one orientation and then remove the platen 104 from engagement with the table 88 and re-engage it in the perpendicular orientation. Cuts or lines formed with the platen 104 in this second orientation will be perpendicular to those formed with the platen 104 in the original orientation (assuming the substrate remains fixed to the upper surface of the platen 104). This significantly expands the possible designs that can be formed using instrument 86.

Instrument 86 can be used by placing a substrate to be modified on the platen 104 and securing it thereto, e.g., using tape or re-positionable spray adhesive. Cutting implement 110 is raised to its non-operative position and platen 104 is engaged with table 88 by aligning an aperture 106 on platen 104 with the projection 94. The plate 120 is adjusted to provide slot 100 with a desired adjustment dimension, i.e., the desired dimension of increment of the platen 104 which is substantially the same as the distance of movement of the rod 90. The cutting implement 110 is lowered to its operative position and the cutting tool 112 is drawn along the slot 116 while it engages with the substrate to cut the substrate, this movement being possible until the cutting tool 112 contacts the locking knob 114. Cutting tool 112 is then returned to its initial position, usually while the cutting implement 110 is apart from the substrate. The lever 98 is slid from one end of the slot 100 toward the opposite end, causing the platen 104 to move at the increment corresponding to the size of the slot 100, and then released, causing the lever 98 to return to its initial position. Cutting tool 112 is again drawn along the slot 116 while it engages with the substrate to cut the substrate a second time, making a second cut substantially parallel to the first cut. The steps of sliding the lever 98 in the slot 100 to cause movement of the platen 104 and drawing of the cutting tool 112 along the slot 116 are sequentially repeated until the desired number of parallel cuts has been formed in the substrate. The cutting implement 110 is then lifted away from the platen 104 to allow the substrate to be removed from the platen 104.

It is pointed out that the above described use of instrument 86 is not limiting and other uses are possible.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A crafting and graphics instrument, comprising:

a table;

a rod mounted in connection with and movable relative to said table;

control means for controlling incremental movement of said rod in one direction relative to said table;

a platen movable relative to said table upon movement of said rod, said platen being arranged to support a substrate thereon; and an implement connected to said table and including an operative tool positionable in engagement with the substrate supported on said platen.

2. The instrument of claim 1, further comprising a plate connected to said rod, said plate having a projection, said platen including at least one aperture each dimensioned to accommodate said projection such that when said projection is accommodated in one of said at least one aperture, said platen moves upon movement of said rod.

3. The instrument of claim 2, wherein said platen is rectangular and includes a first aperture arranged along one edge and a second aperture arranged along a perpendicular edge.

4. The instrument of claim 1, wherein said table defines a channel, said platen being movable in said channel, said implement being mounted over said channel.

5. The instrument of claim 1, wherein said implement includes a slot along which said tool is movable and an adjustable locking mechanism arranged partially in said slot for limiting movement of said tool along said slot.

6. The instrument of claim 1, further comprising movement limiting means for limiting movement of said rod.

7. The instrument of claim 6, wherein said control means comprise a lever coupled to said rod and movable from an initial position in a slot formed on said table and a spring biased to return said lever to the initial position, said movement limiting means comprising an elongate plate arranged on said table and movable to vary the dimension of said slot.

8. The instrument of claim 7, wherein said movement limiting means further comprise locking means for locking said plate in a fixed position relative to said table.

9. The instrument of claim 1, wherein said tool is a cutting tool.

10. A crafting and graphics instrument, comprising:

a table;

a rod mounted in connection with and movable relative to said table;

a control mechanism arranged to control incremental movement of said rod in one direction relative to said table;

a platen movable relative to said table upon movement of said rod, said platen being arranged to support a substrate thereon; and an implement connected to said table and including an operative tool positionable in engagement with the substrate supported on said platen.

11. The instrument of claim 10, further comprising a plate connected to said rod, said plate having a projection, said platen including at least one aperture each dimensioned to accommodate said projection such that when said projection is accommodated in one of said at least one aperture, said platen moves upon movement of said rod.

12. The instrument of claim 11, wherein said platen is rectangular and includes a first aperture arranged along one edge and a second aperture arranged along a perpendicular edge.

13. The instrument of claim 10, wherein said table defines a channel, said platen being movable in said channel, said implement being mounted over said channel.

14. The instrument of claim 13, wherein said implement is mounted at its end to said table on opposite sides of said channel.

15. The instrument of claim 10, wherein said implement includes a slot along which said tool is movable and an adjustable locking mechanism arranged partially in said slot for limiting movement of said tool along said slot.

16. The instrument of claim 10, further comprising a movement limiting mechanism arranged to limit movement of said rod.

17. The instrument of claim 16, wherein said control mechanism comprises a lever coupled to said rod and movable from an initial position in a slot formed on said table and a spring biased to return said lever to the initial position.

18. The instrument of claim 17, wherein said movement limiting mechanism comprises an elongate plate arranged on said table and movable to vary the dimension of said slot.

19. The instrument of claim 18, wherein said movement limiting mechanism further comprises a locking device arranged to engage with and lock said plate in a fixed position relative to said table.

20. The instrument of claim 10, wherein said tool is a cutting tool.

* * * * *